US007767061B2

(12) United States Patent
Urbanek et al.

(10) Patent No.: US 7,767,061 B2
(45) Date of Patent: Aug. 3, 2010

(54) WET/DRY CREPE SWING PAPER MACHINERY

(75) Inventors: Dennis Michael Urbanek, Wausau, WI (US); John Earle Wells, Middletown, OH (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 840 days.

(21) Appl. No.: 11/461,962

(22) Filed: Aug. 2, 2006

(65) Prior Publication Data

US 2008/0029237 A1 Feb. 7, 2008

(51) Int. Cl.
*D21F 7/02* (2006.01)
*D21F 9/00* (2006.01)
*B31C 11/00* (2006.01)

(52) U.S. Cl. ..... 162/281; 162/272; 162/283; 162/289

(58) Field of Classification Search ..... 162/272, 162/280–281, 283, 289
See application file for complete search history.

(56) References Cited

U.S. PATENT DOCUMENTS 4,087,319 A * 5/1978 Linkletter ..... 162/113
5,851,353 A * 12/1998 Fiscus et al. ..... 162/113
6,042,692 A * 3/2000 Myren ..... 162/281
6,077,398 A * 6/2000 Fiscus et al. ..... 162/361
6,207,016 B1 * 3/2001 Ekstrom ..... 162/194
6,613,194 B2 9/2003 Kanitz et al.
6,743,334 B2 * 6/2004 Klerelid et al. ..... 162/118
6,820,837 B2 * 11/2004 Long ..... 242/554.2
6,998,018 B2 2/2006 Klerelid et al.
2002/0162243 A1 * 11/2002 Runge et al. ..... 34/444
2003/0145969 A1 * 8/2003 Mielonen et al. ..... 162/283
2005/0098282 A1 * 5/2005 Scherb ..... 162/123
2007/0075178 A1 * 4/2007 Hada et al. ..... 242/539
2008/0029237 A1 * 2/2008 Urbanek et al. ..... 162/193

* cited by examiner

*Primary Examiner*—José A Fortuna
(74) *Attorney, Agent, or Firm*—Merchant & Gould P.C.

(57) ABSTRACT

A swing paper machine configured to manufacture both wet crepe paper web having a moisture content of at least 20% and dry crepe paper web having a moisture content less than about 15%. The paper machine includes a Yankee dryer having a paper web positioned thereon, a creping doctor blade configured to remove the paper web from the Yankee dryer as either the wet crepe paper web or the dry crepe paper web, a first reel, at least one carrier web, and at least one dryer. The wet crepe paper web is carried by the at least one carrier web to the at least one dryer for reducing a moisture content of the wet crepe paper web. The wet crepe paper web bypasses engagement with the first reel. The dry crepe paper web engages the first reel and is wound into a parent roll. The paper machine is changeable between manufacture of wet and dry crepe paper web without altering a position of the first reel and the at least one carrier web relative to the Yankee dryer.

10 Claims, 8 Drawing Sheets

WET/DRY CREPE SWING PAPER MACHINERY

BACKGROUND OF THE INVENTION

1. Technical Field

The present disclosure relates to paper machinery, and more particularly relates to transfer systems for changing the paper machinery between interchangeably manufacturing wet crepe paper and dry crepe paper on the same paper machine.

2. Related Art

Paper machines adapted for production of rolls of wet and dry crepe paper in the range of, for example, 100 to 300 inches, are large pieces of equipment sometimes more than 100 yards in length and equipped with a large number of rolls. Paper production using this type of paper machinery begins with injecting a paper stock having a consistency of less than 1% paper fiber and at least 99% water into a forming section. In the forming section, the paper stock is supplied to a headbox and passes through a controlling orifice, which feeds the paper stock onto a forming zone. There are many different types of formers for use in the forming zone; among them are the fourdrinier, twin wire, hybrid twin wire, and crescent formers. After the web leaves the forming zone, it is pressed between a pressure roll(s) and a Yankee dryer cylinder. This process transfers water from the paper web and forces the paper fibers in the paper web closer together and starts the transfer of the paper web to the Yankee dryer cylinder. The Yankee dryer heats the paper web and a dryer hood of the Yankee dryer force heated air onto the paper web to remove water by evaporation. An adhesive and release agent is applied to the Yankee dryer to permit transfer and later release of the paper web relative to the Yankee dryer.

The paper web is creped by a creping doctor as it is removed from the Yankee dryer. When a dry crepe paper is being produced, the dry crepe paper web is immediately wound on a reel after being removed from the Yankee dryer. When a wet crepe paper is being produced, the wet crepe paper web after being removed from the Yankee dryer is transferred into a dryer section consisting of dryer fabric(s) and multiple steam dryer cylinders. In some wet crepe machines, the dryer section consists of several steam dryer cylinders. The paper web winds its way over and under the cylinders while being pressed against or held by dryer fabrics, felts or other carrier webbing. While in contact with each dryer cylinder or dryer fabric(s), the paper web absorbs heat. As the paper web travels through the dryer section, evaporation in the paper web occurs to dry the paper web to its final moisture content. A hood positioned over the dyer section removes moisture laden air without applying heated air on the paper web.

Because of the size and complexity of paper machinery, a substantial money and space investment is required to operate a paper machinery. Different paper machinery is usually required to make dry crepe tissue/towel paper versus wet crepe tissue/towel paper. The high capital costs and space requirements necessary for operating two separate sets of paper machinery for dry and wet crepe paper have resulted in the development of swing paper machine that can produce both dry and wet tissue/towel paper products. This type of multi-product machinery requires changing of at least some features of the machinery when changing (swinging) between production runs of wet crepe and dry crepe tissue/towel paper. The process of changing the paper machine between wet and dry crepe production setting is typically very time and labor intensive. The wet and dry crepe change process usually requires movement of large rollers and reels that require large lifting equipment and substantial care and attention. The changing process from dry to wet crepe paper processing also requires warming up the after dryers in the dryer section, which can result in additional down time. As expected, any down time for the paper machinery has a substantial associated cost related to decreased production.

SUMMARY OF THE INVENTION

The present invention relates to wet crepe/dry crepe changing equipment (also referenced as change assembly or changing assembly) for changing paper machinery between a configuration in which the machinery is able to process dry crepe tissue/towel paper and a configuration for processing wet crepe tissue/towel paper. The changing equipment makes use of work space below and above the primary work space in which the main features (e.g., former, Yankee dryer, and dryer section) of the paper machinery operate. The primary work space includes an operating floor that is supported by an equipment support structure (e.g., pillars, posts, etc.). A primary work space is usually positioned vertically above a secondary work space positioned below the operating floor. The changing equipment includes a sub-assembly of features that provides handling of wet crepe paper and a separate sub-assembly of features for handling dry crepe paper. The changing process usually requires no relocation of components during the paper manufacture process. The changing process in some cases may require merely changing the Yankee dryer between a wet crepe setting and a dry crepe setting, and feeding the creped paper web into the dry crepe sub-assembly or into the wet crepe sub-assembly. As a result, the time and cost required for changing between wet and dry crepe tissue/towel paper production in a swing paper machine is substantially reduced as compared to conventional changing assemblies and systems.

BRIEF DESCRIPTION OF THE DRAWINGS

These and other features of the invention will now be described with reference to the drawings of certain embodiments, which are intended to illustrate and not to limit the invention.

DETAILED DESCRIPTION OF THE PREFERRED EMBODIMENT

Figure 1:
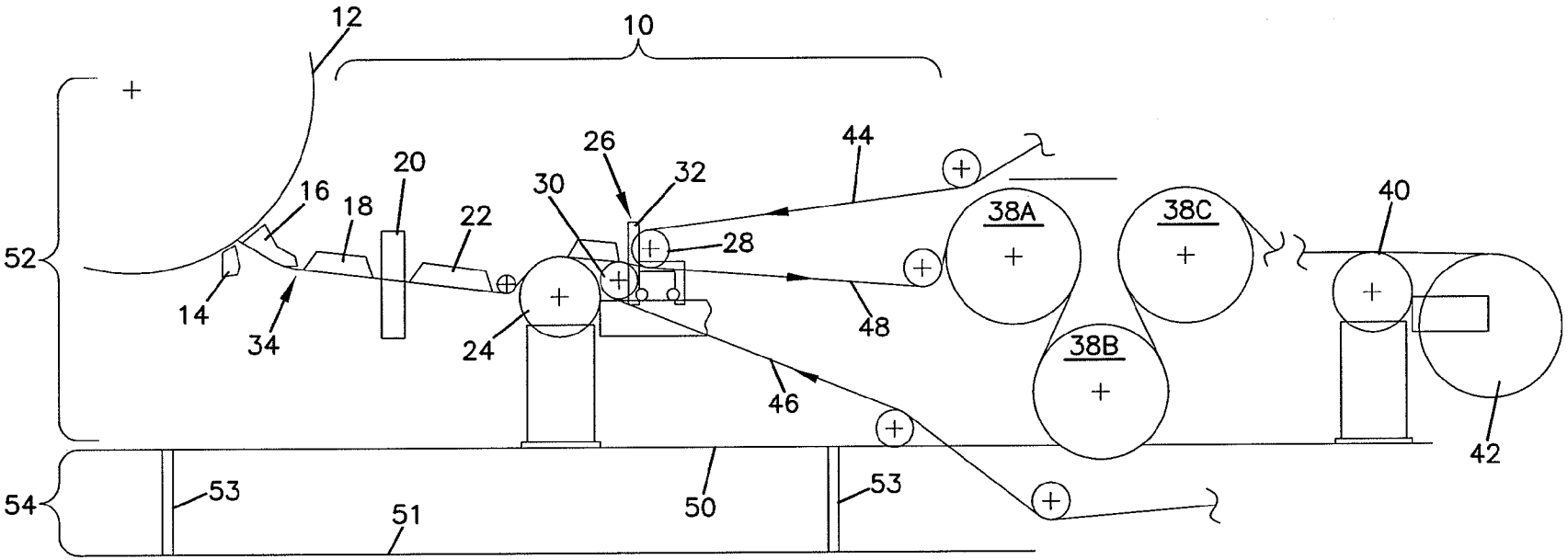
FIG. 1 (PRIOR ART)
FIG. 1 is a diagrammatic depiction of a conventional swing paper machine configured for handling wet crepe tissue/towel paper, wherein the wet crepe paper web extends into a space above the primary work space.

The following description, with reference to the attached drawings, provides a description of several embodiments of portions of a paper machinery set in arrangements for manufacturing dry crepe paper and arrangements for manufacturing wet crepe paper. The ability to change between the various arrangements can result in increased efficiency in both cost and time associated with changing the paper machinery for handling wet and dry crepe paper.

I. GENERAL BACKGROUND

Tissue paper typically has about 2 to about 10 layers of fiber, and most commonly about 2 to about 5 layers of fiber. Tissue paper is usually made with a wet tensile strength that permits the tissue paper to pull apart relatively easily when made wet. Towel paper typically has about 15 to 30 layers of fibers, and most commonly about 20 to about 25 layers of fibers. Towel paper is usually made to a wet tensile strength that resists pulling apart when made wet. Paper wet tensile strength is affected by, for example, the number of fiber layers and the application of chemical coatings during the paper making process. Different types of tissue paper and towel paper can be made using wet crepe and dry crepe paper manufacturing processes.

When making dry crepe paper, a paper web is transferred on to a large drying drum known as a Yankee dryer. Yankee dryers can vary in width and diameter. One example Yankee drying has a diameter of about 15 feet and a width greater than 144 inches. The paper web passes around a pressure roll(s) that presses the paper web against the Yankee dryer. The paper web is secured to a drying surface of the Yankee dryer using and adhesive that is applied onto the drying surface. As the paper web rotates around with the Yankee dryer, the paper web is dried by application of pressurized steam applied from within the Yankee dryer and heated air that is applied from a hood system having a blower that is positioned around the Yankee dryer. Steam pressure from the Yankee dryer and heated air from the hood system can be adjusted to produce a moisture content in the paper web that is specific to dry crepe paper.

The paper web is scraped off of the drying surface of the Yankee dryer by a blade known as a creping doctor blade ("creping doctor"). The action of the creping doctor causes the paper web to become wrinkled or creped, which increases its bulk. The creped paper web has a relatively low moisture content in a dry crepe process. In one example, the dry crepe paper web has a moisture content of about 3% to about 15%. A dry crepe paper web also has a stretch value of about 5% to about 25%. Because of the relatively low moisture content of the dry crepe paper web, the dry crepe paper web can be immediately wound up into a parent roll. The parent roll can then be further processed in separate steps for consumer use.

When making wet crepe paper, a paper web is transferred onto the Yankee dryer. In some instances, the same paper web used for a dry crepe paper process can be used for a wet crepe paper process. In addition to being adhered to the Yankee dryer, the paper web may also have chemicals added to the paper web to increase the wet tensile strength of the paper web. The Yankee dryer and related hood system are set to provide a moisture content in the paper web that is higher than in a dry crepe process. At the point of being removed from the Yankee dryer by the creping doctor, the wet creped paper web has a moisture content of about 20% to about 45%. The wet crepe paper web also has a stretch value of about 3% to 12%. Prior to being rolled into a parent roll and further processed for consumer use, the wet crepe paper web must be dried to have a moisture content of no greater than about 2% to about 15%. After removal from the Yankee dryer, the wet crepe paper web is transferred to and passes over multiple steam drying cylinders in a drying section to lower the moisture content of the wet crepe paper. The wet crepe paper web is typically transported on a single carrying web (e.g., drying felt) for passing through the drying section. After the wet crepe paper web has reached the desired moisture content, the wet crepe paper web is wound up as a parent roll.

The manufacturing steps involved in creating either dry crepe tissue/towel paper or a wet crepe tissue/towel paper can be performed by the same manufacturing equipment if the equipment is arranged in accordance with the present disclosure. The use of one set of manufacturing equipment after the Yankee dryer specific to handling a dry crepe tissue/towel paper web and a separate set of manufacturing equipment for handling a wet crepe tissue/towel paper web, wherein both sets of manufacturing equipment remain in a fixed location relative to the Yankee dryer, makes it possible to quickly change between dry crepe and wet crepe processes.

II. CONVENTIONAL SWING PAPER MACHINE SYSTEM OF FIGS. 1 AND 2

Figure 2:
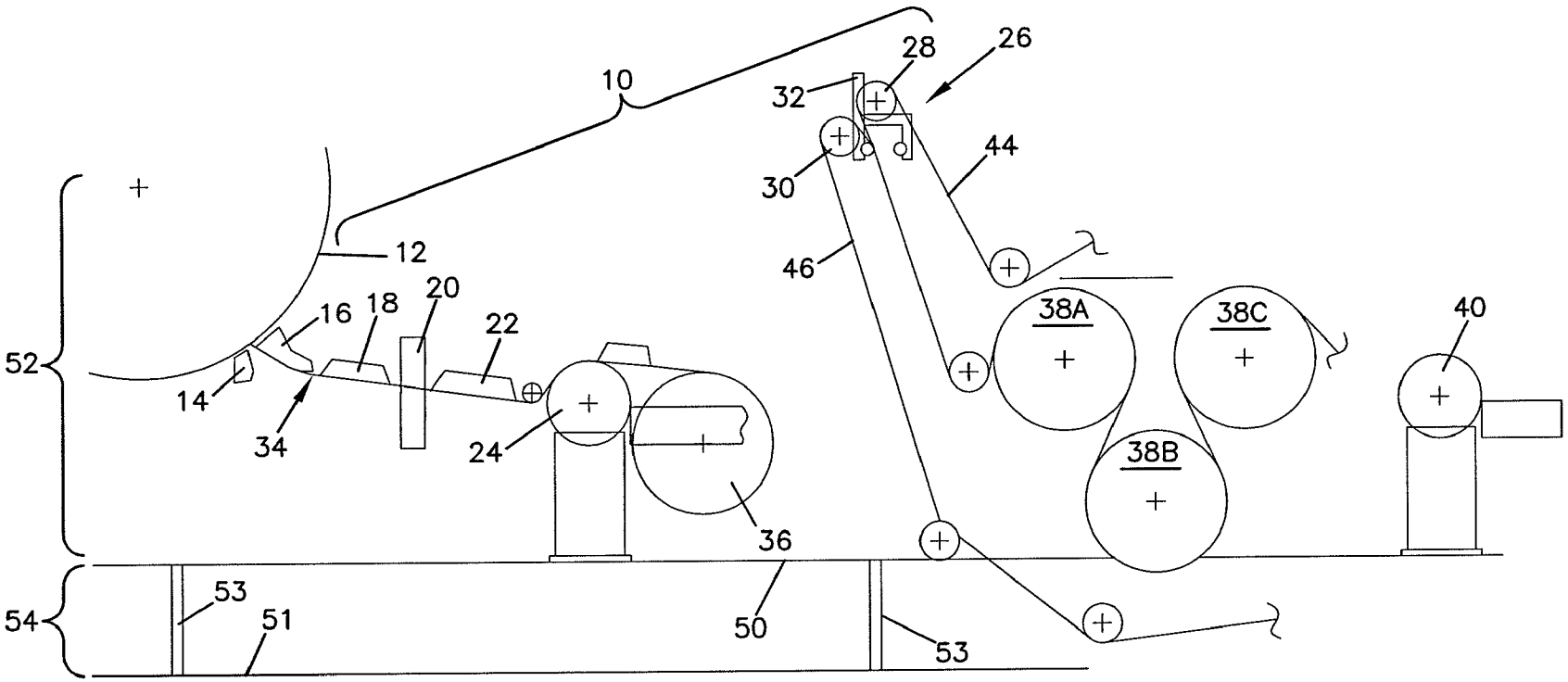
FIG. 2 (PRIOR ART)
FIG. 2 is a diagrammatic depiction of the swing paper machine shown in FIG. 1 configured for handling dry crepe tissue/towel paper.

A conventional swing paper machine having such capabilities is illustrated in part in FIGS. 1 and 2. FIGS. 1 and 2 illustrate a changing assembly 10 of a paper machinery by schematically illustrating those features of the paper machinery from a Yankee dryer 12 through the after dryers 38A-C. FIG. 1 illustrates a configuration of the changing assembly 10 in which the paper machinery is configured for handling wet crepe paper. The changing assembly 10 includes after the Yankee dryer 12, a creping doctor 14, first and second air foils 16, 18, a quality scanner 20, and a secondary air foil 22. The changing assembly 10 further includes a first reel 24 and a wet crepe carrier mechanism 26 that includes rollers 28, 30 supported on a frame 32. A wet crepe paper web 34 is removed from the Yankee dryer by the creping doctor 14. The air foils 16, 18, 22 help maintain the wet crepe paper web 34 in proper alignment and positioning until the wet crepe paper web 34 is transferred over the first reel 24 and into the wet crepe carrier mechanism 26. The number and type of air foils and quality scanners can vary in different embodiments.

First and second carrier webs 44, 46 extend around the first and second rollers 28, 30, respectively. The carrier webs 44, 46 together with at least the rollers 28, 30 (and possibly other rollers that support the carrier webs 44, 46) can be considered a carrier web assembly or arrangement that transfers the wet crepe paper web to the dryers 38A-C. The wet crepe paper web 34 is fed between the first and second carrier webs 44, 46 to create a combined web 48 that is transferred over the after dryers 38A-C for drying and to a second reel 40. The carrier webs 44, 46 are removed from the wet crepe paper web 34 after sufficient drying has occurred to obtain a desired moisture content. The wet crepe paper web is then wound into a second parent roll 42.

Many of the primary components of the paper machinery (e.g., the Yankee dryer 12, first and second reels 24, 40, and after dryers 38A-C) are supported on an operating floor 50, which is supported in a vertically raised position relative to a secondary operating floor 51 by a plurality of support structures 53. A primary working space 52 is defined above the operating floor 50 and a secondary work space 54 is defined between the operating floor 50 and the secondary operating floor 51. Sometimes the operating floor 50 is oriented as a main/ground level of a building and the secondary operating floor 51 is a basement floor of the building. In other arrangements, the operating floor 50 is a mezzanine level of a building that is supported vertically above the secondary operating floor 51 by the support structure 53.

When the paper machinery is being used for manufacturing dry crepe tissue/towel paper, portions of the changing assembly 10 shown in FIG. 1 are not needed. In particular, the additional drying capability of the after dryers 38A-C is not required for a dry crepe paper web. FIG. 2 illustrates the changing assembly 10 changed from the wet crepe paper configuration of FIG. 1 into a dry crepe paper configuration for handling dry crepe tissue/towel paper. As described above, dry crepe paper typically does not require additional drying after being removed from the Yankee dryer with the creping doctor 14. The dry crepe paper web 34, after passing by the air foils 16, 18, 22, and quality scanner 20, travels over the first reel 24 and wound into a parent roll 36.

The changing assembly 10 requires the use of the first reel 24 in the wet crepe paper configuration (FIG. 1) and in the dry crepe paper configuration (FIG. 2). In order to make room for the parent roll 36 in FIG. 2, the wet crepe carrier mechanism 26 must be moved out of the way. In one example, each of the rollers 28, 30 of the wet crepe carrier mechanism 26 weighs in the range of about 300 to about 3,000 pounds, making the wet crepe carrier mechanism 26 difficult to move. Typically, a crane or other lifting device is required to move the wet crepe carrier mechanism 26 (e.g., move into the vertically raised position shown in FIG. 2, or moved into a vertically lower position such as into the secondary work space 54 not shown)). Even if the carrier mechanism 26 is separated into individual components of the roller 28, roller 30 and the frame 32, each of those components can be relatively heavy and time consuming to move. Further, a crane or other lifting device that operates from above is typically required to move the paper roll 36 into and out of the position shown in FIG. 2.

When the wet crepe carrier mechanism 26 is in the removed position shown in FIG. 2, the carrier webs 44, 46 and after dryers 38A-C are inoperable. Typically, moving the wet crepe carrier mechanism 26 into the removed position shown in FIG. 2 reduces tension in the carrier webs 44, 46 below an operating tension amount required to pass the carrier webs 44, 46 through the after dryers 38A-C.

The time required for changing the changing assembly 10 from the arrangement shown in FIG. 1 to the arrangement shown in FIG. 2 and then starting the process of making dry creped paper again is typically several hours. Changing the changing assembly 10 from the configuration shown in FIG. 2 to the configuration shown in FIG. 1 can take an even greater amount of time. When changing to the configuration shown in FIG. 1, the after dryers 38A-C must be warmed up before processing wet crepe paper can begin. Warming up the after dryers 38A-C can take several hours and cannot be started until the carrier mechanism is installed and operational adjacent to the first reel 24 with the operation tension restored to the carrier webs 44, 46. As a result, several additional hours of downtime is required when changing from the configuration shown in FIG. 2 to the configuration shown in FIG. 1 before processing wet crepe paper can begin again. The overall amount of time and resources required to change between the configurations shown in FIGS. 1 and 2 in a conventional paper machinery results in substantial reductions in production efficiency and significant costs in overall operating of the paper machinery.

III. EXAMPLE SYSTEM OF FIGS. 3 AND 4

Figure 3:
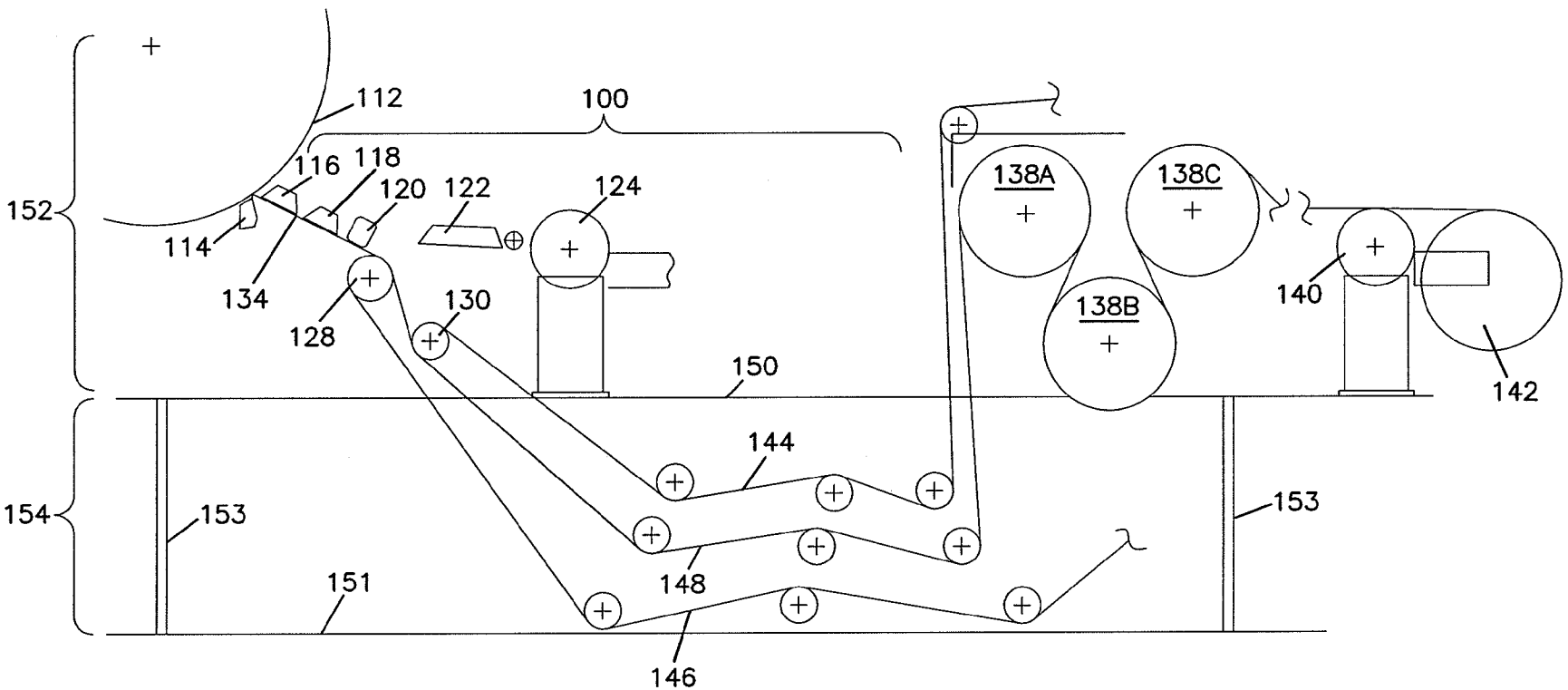
FIG. 3 is a diagrammatic depiction of another example swing paper machine configured for handling wet crepe tissue/towel paper, wherein the wet crepe paper web extends into a space below the primary work space.
Figure 4:
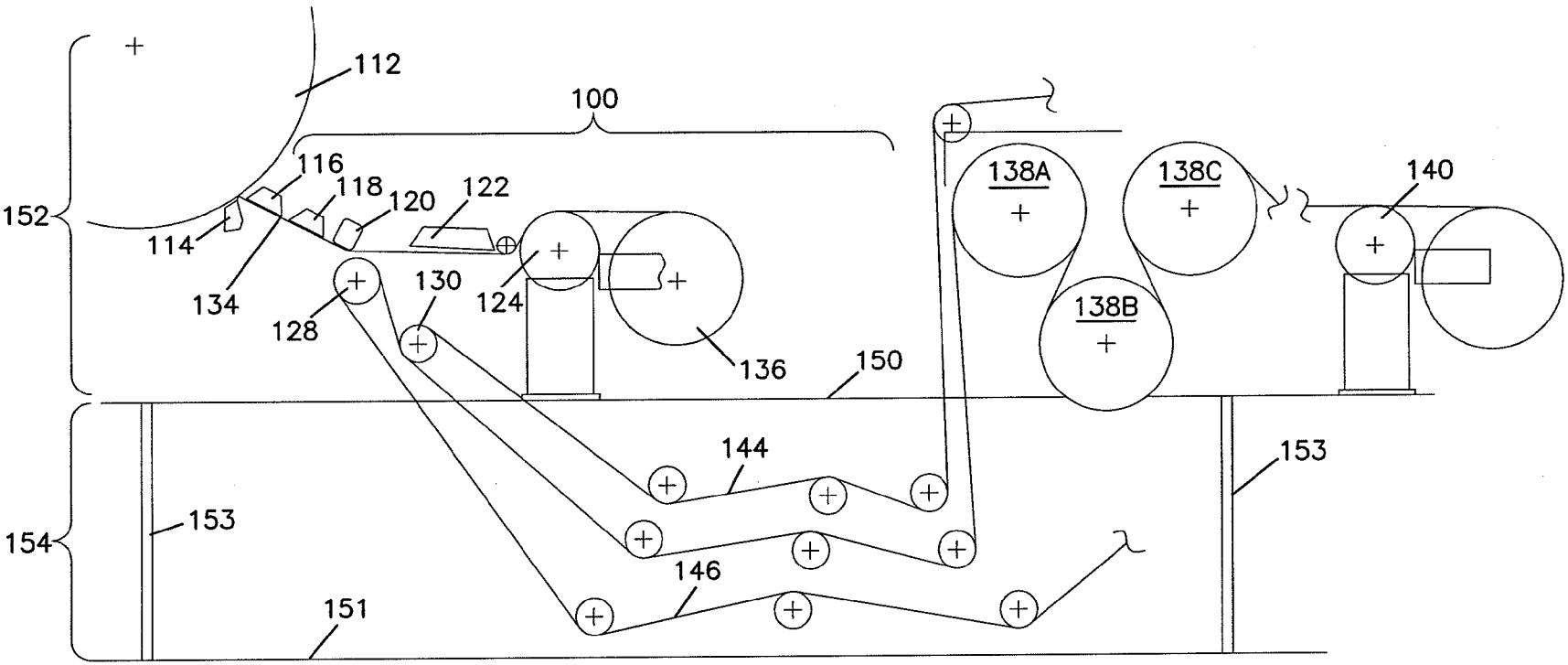
FIG. 4 is a diagrammatic depiction of the swing paper machine shown in FIG. 3 configured for handling dry crepe tissue/towel paper.

Referring now to FIGS. 3 and 4, an example changing assembly 100 for use in a swing paper machine capable of producing dry crepe tissue/towel paper and wet crepe tissue/towel paper is shown and described. FIG. 3 illustrates the changing assembly 100 in an arrangement configured for processing wet crepe tissue/towel paper. FIG. 4 illustrates the changing assembly 100 in an arrangement configured for processing dry crepe tissue/towel paper.

The changing assembly 100 includes after a Yankee dryer 112, a creping doctor 114, air foils 116, 118, 122, and a quality sensor 120. The changing assembly 100 further includes a first reel 124, rollers 128, 130, after dryers 138A-C, a second reel 140, and a second parent roll 142 (see FIG. 3). A wet or dry crepe paper web 134 is removed from the Yankee dryer 112 with the creping doctor 114. FIG. 3 illustrates a wet crepe paper web 134 passing by the air foils 116, 118 and the quality scanner 120 and into engagement with carrier web 146 that is wound around the roller 128. Another carrier web 144 winds around the roller 130 and into engagement with an opposing side of the wet crepe paper web 134 from the carrier web 146. The combined web 148 of wet crepe paper web 134 and carrier webs 144, 146 is transferred to the after dryers 138A-C where the wet crepe paper web 134 is dried to a desired moisture content. The carrier webs 144, 146 are removed from the wet crepe paper web 134, and the wet crepe paper web 134 is carried over the second reel 140 and wound into the second parent roll 142.

The carrier webs 144, 146 together with at least the rollers 128, 130 (and possibly other rollers that support the carrier webs 44, 46) can be considered a carrier web assembly or arrangement that transfers the wet crepe paper web to the dryers 38A-C. The carrier web arrangement provides a path for the paper web 134 that bypasses the first reel 124 and a first parent roll 136.

It is noted with reference to FIG. 3 that the wet crepe paper web 134 bypasses the first reel 124 by traveling through a secondary workspace 154 defined between an operating floor 150 and a secondary operating floor 151. The operating floor 150 is supported vertically above the secondary workspace 154 by a support structure 153. The operating floor 150 supports the Yankee dryer 112, after dryers 138A-C, and other primary components of the paper machinery. When the carrier webs 144, 146 and combined web 148 extend below the operating floor 150 as shown in FIG. 3, there is sufficient room above the first reel 124 to access the first parent roll 136 during manufacture of either wet crepe paper or dry crepe paper (described below with reference to FIG. 4) at all times. Thus, the first parent roll 136 does not have to be removed when processing wet crepe paper, and does not have to be replaced when changing to a dry crepe process (see FIG. 4). Further, the carrier webs 144, 146 and the rollers 128, 130 can maintain a fixed position relative to the Yankee dryer 112 and first reel 124 when manufacturing wet crepe paper (see FIG. 3) as well as when manufacturing dry crepe paper (see FIG. 4).

FIG. 4 illustrates the changing assembly 100 configured for manufacturing dry crepe paper. The dry crepe paper web 134 shown in FIG. 4 is created by scraping a dry crepe paper web off of the Yankee dryer 112 using the creping doctor 114. The dry crepe paper web 134 passes by the air foils 116, 118, 122 and the quality scanner 120 before extending over the first reel 124 and being wound into the first parent roll 136. The path for paper web 134 from the creping doctor 114 to the first reel 124 and the first parent roll 136 is a path that bypasses the carrier web assembly (i.e., carrier webs 144, 146 and rollers 128, 130). As discussed above, the low moisture content of the dry crepe paper web 134 permits winding the dry crepe paper web into the first parent roll 136 without further drying with the after dryers 138A-C.

Changing of the changing assembly 100 between the arrangements shown in FIGS. 3 and 4 for manufacturing wet and dry crepe tissue/towel paper is relatively simple and requires minimum time. For example, changing from the configuration shown in FIG. 3 to the configuration shown in FIG. 4 merely requires changing the settings of the Yankee dryer and associated hood system to create a dry crepe paper web instead of a wet crepe paper web, feeding the dry crepe paper web 134 over the first reel 124, and winding the dry crepe paper web 134 into the first parent roll 136. Likewise, changing from the configuration shown in FIG. 4 to the configuration shown in FIG. 3 requires merely changing the settings of the Yankee dryer and associated hood system to create a wet crepe paper web instead of a dry crepe paper web, and feeding the wet crepe paper web 134 between the carrier webs 144, 146. The carrier webs 144, 146 carry the wet crepe paper web 134 through the after dryers 138A-C after which the wet crepe paper web is fed over the second reel 140 and wound into the second parent roll 142. Changing between the configurations of FIGS. 3 and 4 for manufacturing wet or dry crepe tissue/towel paper requires no repositioning of components of the paper machinery relative to each other. The change can be a simple as adjusting moisture content settings and feeding the wet or dry crepe paper web to one or another path (e.g., a path to the first reel 124 for the dry crepe paper web or a path to the carrier webs 144, 146 for the wet crepe paper web). The total time for changing between the configurations of FIGS. 3 and 4 can be a few minutes rather than the hours of time required when changing between the configurations of FIGS. 1 and 2 in a conventional swing tissue/towel paper machine.

The changing assembly 100 of FIGS. 3 and 4 can also result in time savings related necessary to pre-heating the after dryers 138A-C when changing between dry and wet creping configurations. The carrier webs 144, 146 and after dryers 138A-C are operable during manufacture of dry crepe paper using the configuration of FIG. 4. Therefore, even when no wet crepe paper web is handled by the carrier webs 144, 146 and the after dryers 138A-C, the after dryers 138A-C can be turned on and heated up in advance of changing from the dry crepe configuration shown in FIG. 4 to the wet crepe configuration shown in FIG. 3.

IV. EXAMPLE SYSTEM OF FIGS. 5 AND 6

Figure 5:
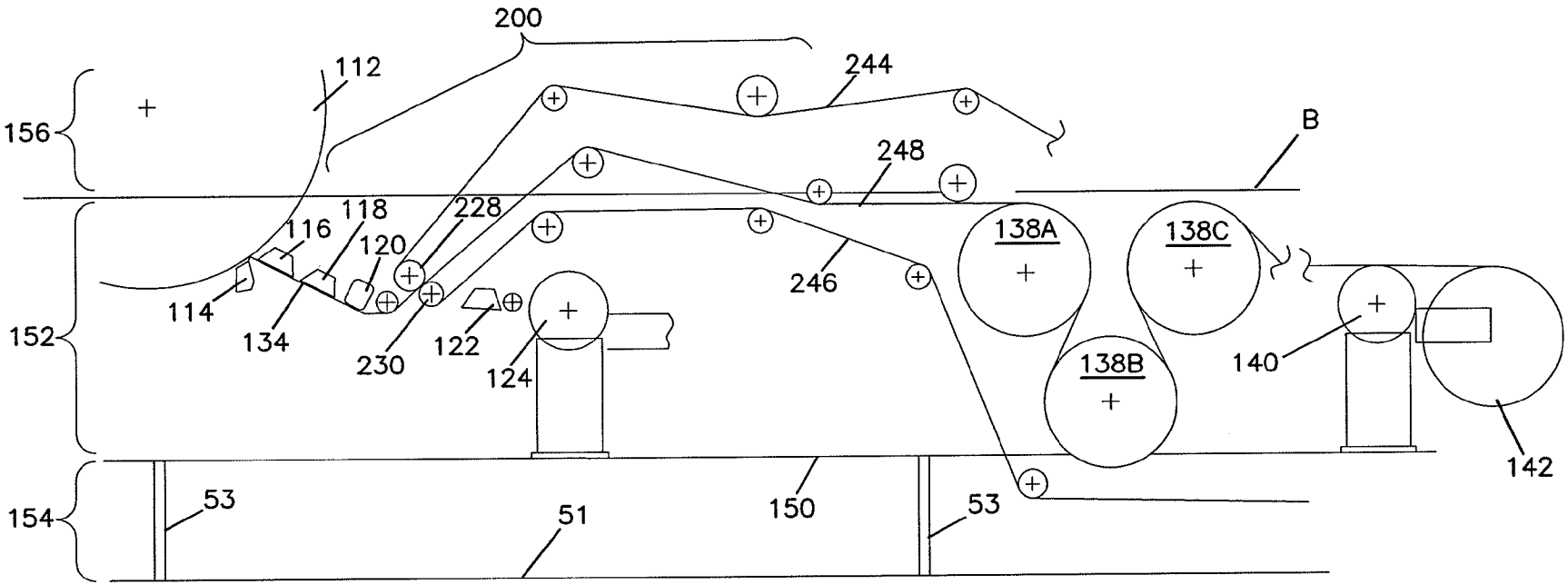
FIG. 5 is a diagrammatic depiction of another example swing paper machine configured for handling wet crepe tissue/towel paper, wherein the wet crepe paper web extends into a space above the primary work space.
Figure 6:
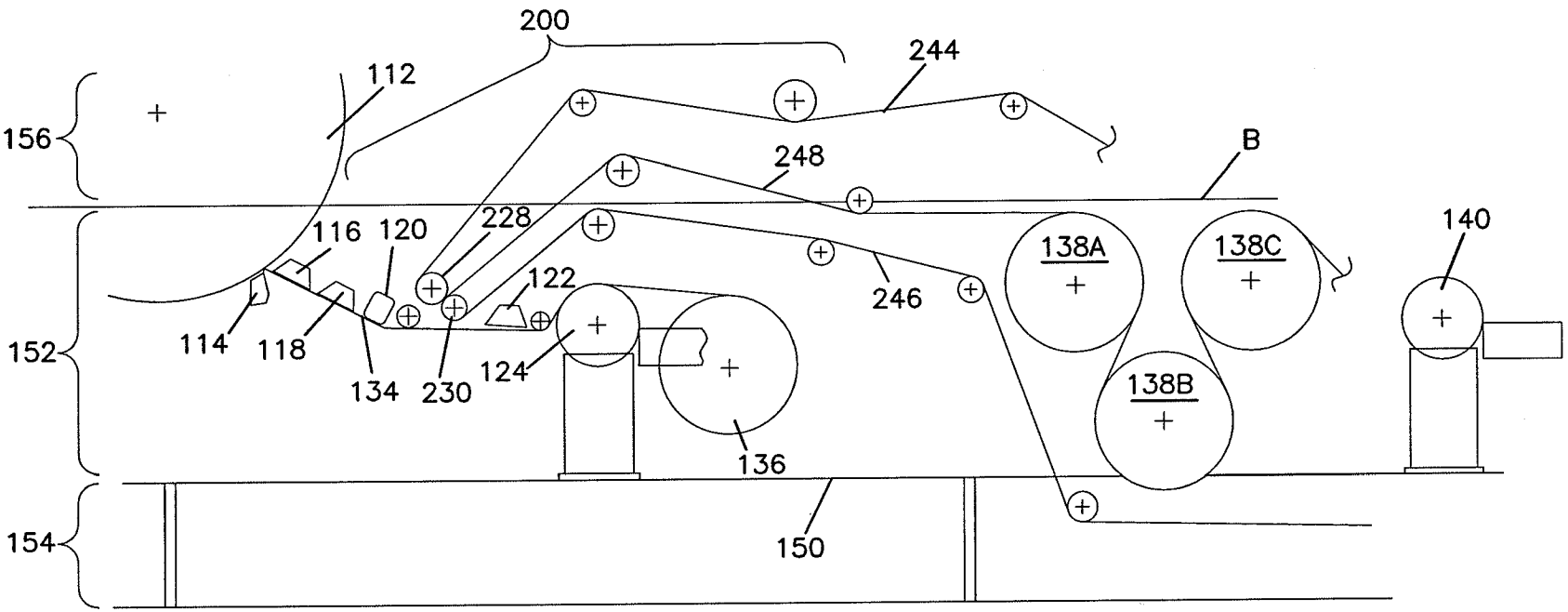
FIG. 6 is a diagrammatic depiction of the swing paper machine shown in FIG. 5 configured for handling dry crepe tissue/towel paper.

Referring now to FIGS. 5 and 6, another example changing assembly 200 is shown and described. The changing assembly 200 includes many of the same components described above with reference to FIGS. 3 and 4. A primary difference between changing assembly 100 and changing assembly 200 is that the rollers 228, 230 and associated carrier webs 244, 246 extend vertically above the first reel 124 and first parent roll 136 (FIGS. 5 and 6) rather than vertically below the first reel 124 and first parent roll 136 (FIGS. 3 and 4).

The rollers 228, 230 and carrier webs 244, 246 extend in an upper work space 156 that is vertically above a primary working space 152 (described above). A dividing line B is shown in FIGS. 5 and 6 at a position that generally divides the upper work space 156 from the primary work space 152. While the primary and secondary work spaces 152, 154 are fairly well defined as being above and below the operating floor 150, respectively, the upper work space 156 is loosely defined as the working space vertically above components of the paper machinery supported on the floor 154, (e.g., first and second reels 124, 140, parent rolls 136, 142, and after dryers 138A-C). However, in other embodiments, the rollers 228, 230 and carrier webs 244, 246 may extend into the primary work space 152 and be supported by the operating floor 150.

In the embodiments shown in FIGS. 3-6, one or both of the rollers 128, 130, 228, 230, and other of the unlabeled rollers supporting carrier webs 144, 146, 244, 246 and the combined webs 148, 248 can be moved between a first position and a second position. For example, referring to the configuration shown in FIGS. 3 and 4, the rollers 128, 130 can be coupled to a pivotable arm (not shown) that pivotally moves the rollers 128, 130 between an first position in which the rollers 128, 130 support the carrier webs 144, 146 in a position for receiving the wet crepe paper web 134, to a removed second position where the carrier webs 144, 146 are not positioned to receive the wet crepe paper web 134. In one arrangement, the second position for the rollers 128, 130 is a position below the operating floor 150. The pivotable arm (not shown) and other features supporting the webs 144, 146, 148 and rollers 128, 130 can be configured to maintain an operating tension within the webs 144, 146 when the rollers 128, 130 are in the second position to permit operating of the webs 144, 146 and after dryers 138A-C during manufacture of dry crepe paper. In such a configuration, moving the supporting arm into the first position can be part of the changing process between configuration for manufacturing wet and dry crepe paper.

Moving the pivotable arm could be accomplished manually or automatically using, for example, a hydraulic ram. A similar movable support member could be used with the arrangement shown in FIGS. 5 and 6. Alternative structures could be used besides a pivoting arm such as, for example, a changing assembly that translates horizontally or vertically or at an angle relative to the floor 150 to move the rollers and carrier webs between an first position capable of receiving the wet crepe paper web and a removed, second position not capable of receiving the wet crepe paper web. Preferably, as discussed above, tension is maintained in the carrier webs when moving the rollers between the first and second positions so as to permit warming up of the after dryers before changing to a wet crepe paper configuration such as the arrangement shown in FIGS. 3 and 5.

V. EXAMPLE SYSTEM OF FIGS. 7 AND 8

Figure 7:
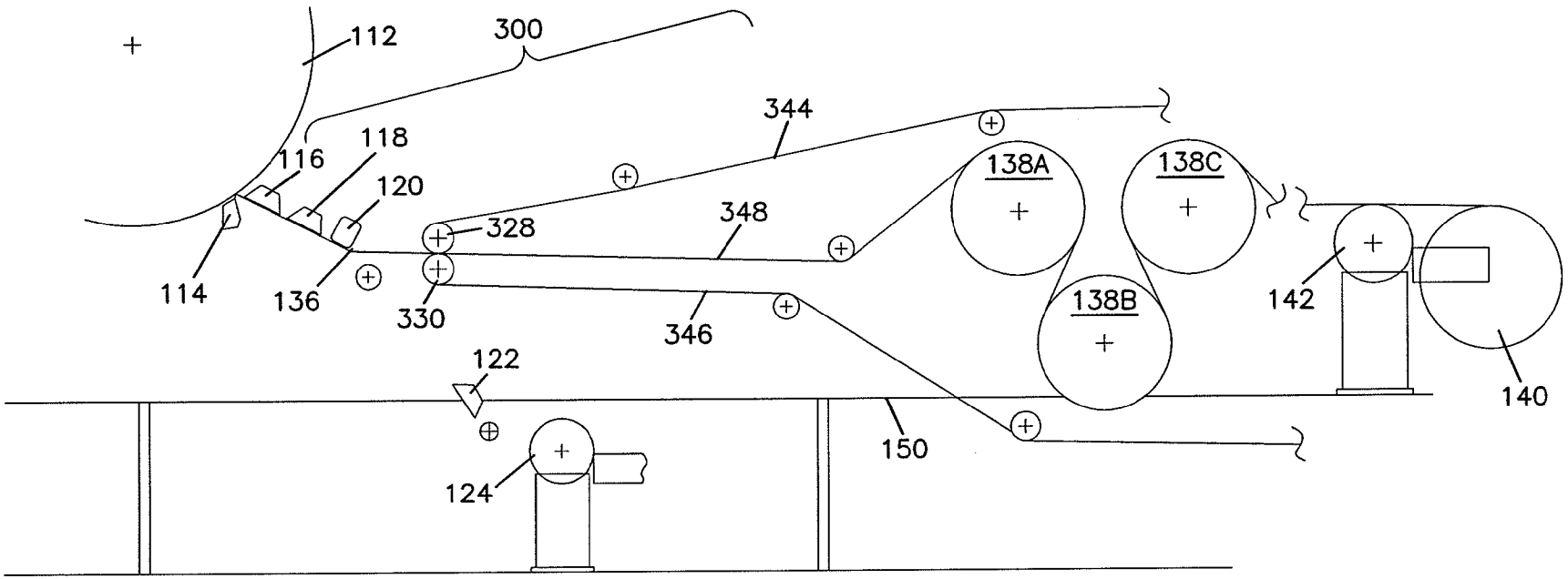
FIG. 7 is a diagrammatic depiction of another example swing paper machine configured for handling wet crepe tissue/towel paper, wherein the wet crepe paper web remains in the primary work space.
Figure 8:
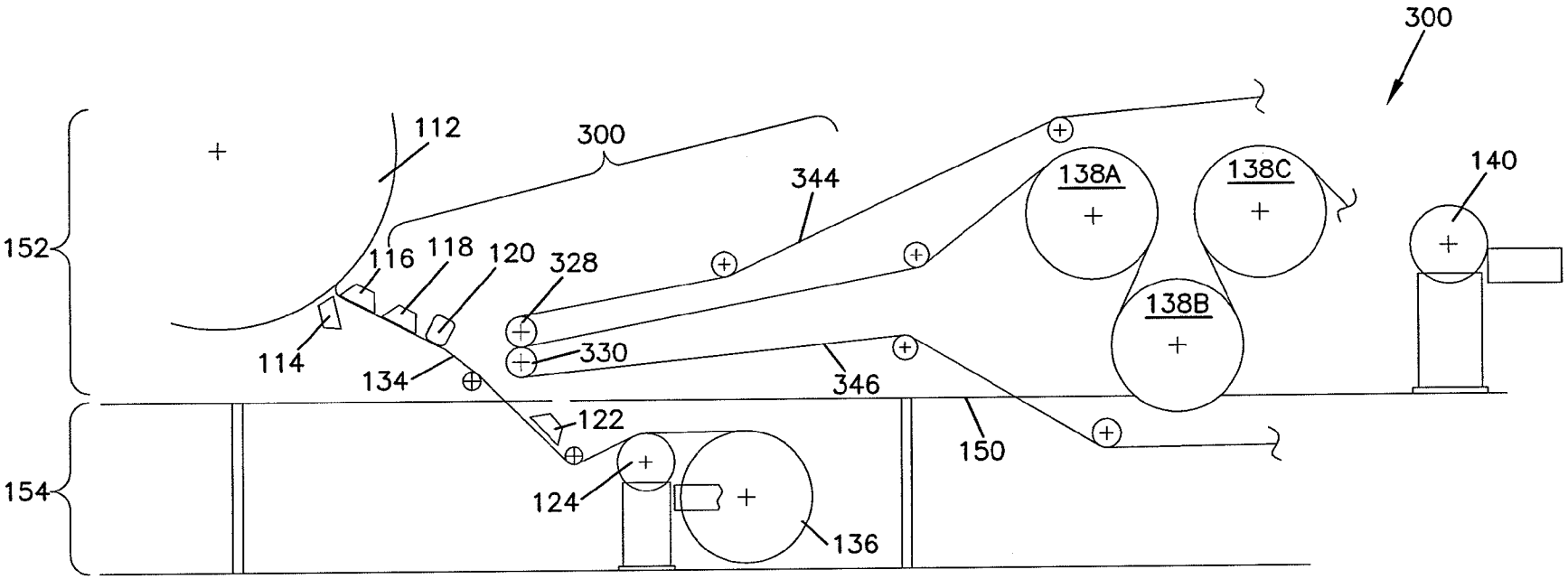
FIG. 8 is a diagrammatic depiction of the swing paper machine shown in FIG. 7 configured for handling dry crepe tissue/towel paper, wherein the dry crepe paper web extends into a space below the primary work space.

Referring now to FIGS. 7 and 8, another example changing assembly 300 is shown and described. Changing assembly 300 includes an arrangement shown in FIG. 7 for handling wet crepe paper web, and an arrangement in FIG. 8 wherein the changing assembly 300 is configured for handling dry crepe paper web. FIGS. 7 and 8 include the first reel 124 and first parent roll 136 positioned below the operating floor 150 in the secondary work space 154. The first reel 124 and first parent roll 136 can be supported on the secondary operating floor 153.

Referring to FIG. 8, when the wet crepe paper web 134 is removed from the Yankee dryer 112, the dry crepe paper web 134 travels beneath the floor 150 where it passes over the first reel 124 and is wound into the first parent roll 136. FIG. 7 illustrates the features for manufacturing the wet crepe paper web positioned primarily above the floor 150. That is, the rollers 328 and 330 and other rollers supporting carrier webs 344, 346 are positioned in the primary work space 152 vertically above the floor 150. The configuration of changing assembly 300 can provide advantages such as, for example, optimization of space on the operating floor 150 and more efficient use of space in the secondary work space 154

VI. SUMMARY AND CONCLUSION

There are many considerations involved in selecting among or modifying the transfer assemblies 100, 200, 300 shown in FIGS. 3-8 for use in paper machinery that can result in certain advantages or disadvantages. In some situations, it may be impractical to generate parent rolls 136 of dry crepe paper in the secondary work space 154 as shown in FIG. 8 because it can be difficult to handle the parent rolls 136 in an area where there are typically no overhead lifts available. A further challenge related to the arrangement of FIGS. 7 and 8 is the need for man power on a single level when operating the paper machinery. It is typically desired to have all operators of a paper machinery working on the same floor (e.g., the operating floor 150) rather than being separated onto two floors, which could be required with the arrangement of FIGS. 7 and 8.

Positioning the rollers 228, 230 in the upper space 154 as shown in FIGS. 5 and 6 may be impractical in some situations because the carrier webs 244, 246 might block access to the first reel 124 and first parent roll 136. Access to the first reel 124 and parent roll 126 is typically desired for operating lifts or other mechanism from above that are needed to move the reel 124 and first parent roll 136. Providing adjustability of the position of rollers 228, 230 and carrier webs 244, 246 between first and second positions adjacent to and removed from the first reel 124, preferably while maintaining tension in the carrier webs that permits operating of the after dryers 138A-C, could render the embodiment of FIGS. 5 and 6 more practical.

One aspect of the present disclosure relates to a paper machinery adapted for manufacturing both wet crepe paper and dry crepe paper. The machinery includes a Yankee dryer configured to alter a moisture content of a paper web, a creping doctor, a first reel, and a carrier web arrangement. The creping doctor is arranged to remove the paper web from the Yankee dryer as either a wet crepe paper web or a dry crepe paper web depending on the moisture content of the paper web. The first reel is arranged at a fixed location relative to the Yankee dryer to transfer the dry crepe paper web to a first parent roll. The carrier web arrangement is arranged at a fixed location relative to the Yankee dryer to transfer the wet crepe paper web to a dryer. The carrier web arrangement bypassing the first reel so that the wet crepe paper web does not engage the first reel.

Another aspect of the present disclosure relates to a portion of a swing paper machine capable of manufacturing wet crepe paper and dry crepe paper. The portion of the swing paper machine includes Yankee dryer, at least one carrier web, a first reel, and an after dryer. The Yankee dryer, the at least one carrier web, the first reel, and the after dryer maintain a fixed operational position relative to each other during changing between manufacture of wet crepe paper and manufacture of dry crepe paper. During manufacture of dry crepe paper, a paper web having a moisture content of no greater than about 12% to about 15% is removed from the Yankee dryer as a dry crepe paper web. The dry crepe paper web engages the first reel and is wound into a first parent roll. When manufacturing wet crepe paper, a paper web having a moisture content of no less than about 20% is removed from the Yankee dryer as a wet crepe paper web. The wet crepe paper web is transferred to the at least one carrier web, the at least one carrier web carries the wet crepe paper web to the after dryer to reduce the moisture content of the wet crepe paper web, and the wet crepe paper web is wound into a second parent roll.

A further aspect of the present disclosure relates to a method of changing a paper machinery between manufacturing a wet crepe paper and manufacturing a dry crepe paper. The paper machinery includes a Yankee dryer having a paper web positioned thereon, a creping doctor blade, a first reel, a second reel, and a carrier web arrangement. The method includes removing the paper web from the Yankee dryer as a dry crepe paper web, and passing the dry crepe paper web over the first reel and winding the dry crepe paper web into a first parent roll. The method also includes removing the paper web from the Yankee dryer as a wet crepe paper web, and transferring the wet crepe paper web onto the carrier web arrangement without the wet crepe paper web engaging the first reel.

A still further aspect in accordance with the present disclosure relates to a method of changing a paper machinery between a first arrangement for manufacture of a wet crepe paper web and a second arrangement for manufacture of a dry crepe paper web. The paper machinery includes a Yankee dryer having a paper web positioned thereon, a creping doctor blade configured to remove the paper web from the Yankee dryer as either the wet crepe paper web or the dry crepe paper web depending on a moisture content of the paper web, a first reel, at least one carrier web, and at least one dryer. The wet crepe paper web is carried by the at least one carrier web to the at least one dryer for reducing a moisture content of the wet crepe paper web. The dry crepe paper web engages the first reel before being wound into a parent roll. The method includes changing between the first and second arrangements without altering a position of the first reel and the at least one carrier web relative to the Yankee dryer. The method can also include moving the wet crepe paper web to the at least one carrier web without engaging the first reel when changing between manufacture of wet and dry crepe paper web.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A portion of a swing paper machine capable of manufacturing wet creped paper and dry creped paper, the portion of the swing paper machine comprising:

(a) a Yankee dryer including a creping doctor;

(b) at least one carrier web arranged to receive wet creped paper, having a moisture content of no less than about 20%, from the Yankee dryer during manufacture of wet creped paper;

(c) an after dryer that receives the wet creped paper from the at least one carrier web;

(d) a wet creped paper winding reel that receives wet creped paper from the after dryer; and e) a dry creped paper winding reel arranged to receive dry creped paper, having a moisture content of no greater than about 15%, from the Yankee dryer during manufacture of dry creped paper, the dry creped paper winding reel being a different reel than that of the wet creped paper winding reel;

(f) wherein the wet creped paper bypasses the dry creped paper winding reel during manufacture of wet creped paper;

(g) wherein the Yankee dryer, the at least one carrier web, the dry creped paper winding reel, and the after dryer maintain a fixed operational position relative to each other during changing between manufacture of wet creped paper and manufacture of dry creped paper.

2. The portion of a swing paper machine of claim 1, wherein at least a portion of the at least one carrier web extends vertically below the first dry creped paper winding reel.

3. The portion of a swing paper machine of claim 1, wherein the after dryer is operational to heat up to an operating temperature during manufacture of the dry creped paper.

4. A portion of a swing paper machine capable of manufacturing wet creped paper and dry creped paper, the portion of the swing paper machine comprising:

(a) a drum dryer including a creping doctor;

(b) at least one carrier web arranged to receive wet creped paper from the drum dryer;

(c) a first reel and a second reel, the first reel being arranged to receive dry creped paper from the drum dryer, the second reel being arranged to receive wet creped paper from the drum dryer; and (d) an after dryer positioned between the at least one carrier and the second reel, the after dryer being arranged to receive wet creped paper from the at least one carrier web;

(e) wherein wet creped paper bypasses the first reel during wet creped paper manufacture;

(f) wherein the drum dryer, the at least one carrier web, the first reel, and the after dryer maintain a fixed operational position relative to each other during conversion from one of wet creped paper manufacture and to dry creped paper manufacture to the other of wet creped paper manufacture and dry creped paper manufacture.

5. The portion of a swing paper machine of claim 4, wherein during dry creped paper manufacture, a dry creped paper web engages the first reel and is wound into a first roll, and wherein during wet creped paper manufacture, a wet creped paper web is transferred to the at least one carrier web, which in turn carries the wet creped paper web to the after dryer and is subsequently wound into a second roll.

6. The portion of a swing paper machine of claim 4, wherein the at least one carrier web directs the wet creped paper beneath the first reel.

7. The portion of a swing paper machine of claim 4, wherein the after dryer is operational during dry creped paper manufacture so as to heat to an operating temperature prior to conversion to wet creped paper manufacture.

8. The portion of a swing paper machine of claim 4, wherein the drum dryer selectively alters the moisture content of a paper web to that of the moisture content of one of wet creped paper and dry creped paper.

9. The portion of a swing paper machine of claim 4, further including a blade that removes a paper web from the drum dryer.

10. The portion of a swing paper machine of claim 9, wherein dry creped paper manufacture utilizes a paper web having a moisture content of no greater than about 15% when removed from the drum dryer, and wherein wet creped paper manufacture utilizes a paper web having a moisture content of no less than about 20% when removed from the drum dryer.

* * * * *

UNITED STATES PATENT AND TRADEMARK OFFICE

CERTIFICATE OF CORRECTION

PATENT NO. : 7,767,061 B2
APPLICATION NO. : 11/461962
DATED : August 3, 2010
INVENTOR(S) : Urbanek et al.

It is certified that error appears in the above-identified patent and that said Letters Patent is hereby corrected as shown below:

Col. 11, line 6, claim 2: "below the first dry creped paper" should read --below the dry creped paper--

Col. 11, line 31, claim 4: "manufacture and to dry creped" should read --manufacture and dry creped--

Signed and Sealed this
Fourth Day of January, 2011

David J. Kappos

David J. Kappos
*Director of the United States Patent and Trademark Office*